United States Patent [19]

Stolarczyk et al.

[11] Patent Number: 4,753,484

[45] Date of Patent: Jun. 28, 1988

[54] METHOD FOR REMOTE CONTROL OF A COAL SHEARER

[75] Inventors: Larry G. Stolarczyk; David L. Baldridge, both of Raton, N. Mex.

[73] Assignee: Stolar, Inc., Raton, N. Mex.

[21] Appl. No.: 922,525

[22] Filed: Oct. 24, 1986

[51] Int. Cl.[4] ..... E21C 35/24

[52] U.S. Cl. ..... 299/1; 299/30

[58] Field of Search ..... 299/1, 30; 173/20, 21

[56] References Cited

U.S. PATENT DOCUMENTS

| | | | |
|---|---|---|---|
| 3,407,002 | 10/1968 | Pidgeon | 299/1 |
| 4,634,186 | 1/1987 | Pease | 299/1 |

FOREIGN PATENT DOCUMENTS

| | | | |
|---|---|---|---|
| 2612368 | 10/1977 | Fed. Rep. of Germany | 299/30 |
| 2113436 | 8/1983 | United Kingdom | 299/30 |
| 0286910 | 8/1971 | U.S.S.R. | 299/1 |
| 0779577 | 11/1980 | U.S.S.R. | 299/30 |
| 0899933 | 1/1982 | U.S.S.R. | 299/1 |

OTHER PUBLICATIONS

Zimmerman et al., "Automation of the Longwall Mining System", JPL Publication, 82-99, pp. IV to IX, 1-1 to 1-7 and 3-1 to 3-8, Nov. 1982.

Chang et al. "An Analysis of a Resonant Loop as an Electomagnetic Sensor of Coal Seam Thickness", Proceedings of URSI Conference on Remote Sensing, Apr./May 1977.

Dobroski et al., "Control and Monitoring via Medium-Frequency Techniques and Existing Mine Conductors", IEEE Transactions on Industry Applications, vol. 1A-21, pp. 1087-1092, Jul./Aug. 1985.

*Primary Examiner*—Stephen J. Novosad
*Assistant Examiner*—David J. Bagnell
*Attorney, Agent, or Firm*—Thomas E. Schatzel

[57] ABSTRACT

A method for remotely controlling the mechanical functions of a coal cutting machine's electrohydraulic system which utilizes a medium frequency remote control communication system and a coal-rock interface sensor. The coal-rock interface sensor is a shielded resonant horizontal loop antenna.

8 Claims, 1 Drawing Sheet

METHOD FOR REMOTE CONTROL OF A COAL SHEARER

BACKGROUND OF THE INVENTION

1. Field of the Invention

The present invention relates generally to coal shearing machines and more particularly to a method for controlling a coal shearing machine from a remote location using a medium frequency communications systems and coal-rock interface sensors.

2. Description of the Prior Art

For the past several years, supply in the coal mining industry has exceeded demand. This over-supply has led to an increase in the industry's competitive intensity which, in turn, has led to a heightened awareness by coal producers of the need to reduce cost and risk in mining operations. In opposition to the desire to cut costs and improve safety, is the problem that only deeper, thinner, lower quality and higher cost coal reserves are left to mine.

In an effort to aid the mining industry in resolving this dilemma, the Jet Propulsion Laboratory (JPL) conducted a study aimed at evaluating automated longwall mining technology. See W. Zimmerman, R. Aster, J. Harris and J. High, *Automation of the Longwall Mining System,* JPL Publication 82-99 (Nov. 1, 1982). Among other things, this study identifies the need for developing remote control technology for longwall shearer operations.

Remote control of the shearer requires short range sensing of the coal-rock interface in order to keep mine personnel out of the hazardous coal cutting zone (face). Continuous and longwall mining requires the operator to be in close proximity to the coal cutting edges (drum) so he can see the cutting horizon and keep the cutting edges from striking rock. In the process, the shearer operator is constantly in a hazardous area. If the shearer cutting edges are allowed to strike rock, flying sparks can cause methane and coal dust ignitions. Cutting into sandstone roof/floor produces silica in the dust which causes non-compliance with MSHA respirable dust regulations. In mining, the hazard is often alleviated by slowing down the tram rate of the shearer, cutting only in the direction of the face ventilation air stream, or increasing the water spray to disperse the dust plume. In addition to the dust problem, wear and tear on the cutting drum and bearings of the mechanical drive components often leads to increased down time and maintenance problems.

Another requirement for effectively automating a longwall mining system is the development of a reliable remote control communication system. Various longwall manufacturers in the U.S. and Europe currently offer VHF (very high frequency) and LF (low frequency) remote control systems. The LF system consists of a control link from the headgate command center to the shearer via the AC power cable. The LF system is limited since it does not allow remote control from a shearer operator anywhere along the face. VHF and UHF systems work well on line of sight signal propagation paths to control continuous mining equipment and roof bolters. The technology fails, however, in the remote control of trains in tunnels and loading panels such as are used in block cave mining. The reasons why the VHF and UHF systems fail to work in such situations are: VHF and UHF signals suffer great attenuation when propagating down the waveguide created by the shield and pan line, reliable control is limited to line-of-site operation, rolls along the face can limit control range, and the reflected signal energy from the longwall steel support members produce nulls in the transmitting waves. Because of the problems associated with VHF and UHF transmissions, the radio transmission signal in the "dead control" null zone will be below that required for a low bit error rate. This excessive bit rate results in command signals being improperly decoded or not responded to at all.

To enable the control of the shearer (or continuous miner) from a safe distance, various attempts have been made to develop coal-rock sensor technology. In Europe and the U.S., researchers have investigated natural radiation background sensor technology. Using the natural background radiation of the above strata, this system allows the coal thickness above the shearer to be measured and maintained as the shearer cuts; however, this sensor fails to reliably work in some geologies. Other similar applications of technology include the use of acoustics and the "sensitive pick" for seam thickness measurement and coal-rock interface detection, and the investigation of microwave measuring techniques by researchers at the National Bureau of Standards. The thrust of the natural radiation background sensor, acoustics and microwave measuring technologies was to increase the shearer operator's control capability so he could cut the maximum amount of coal possible with each pass.

Other sensors were developed to solve face alignment problems contributing to many conveyor and pan line failures. One of these sensors was the yaw measurement sensor developed by the Benton Corporation. This sensor measures angular deviations in the pan line and transmits information to a computer. The computer determines the position of the shearer and the straightness of the face conveyor. In a U.S. Government report, the NASA Marshall Space Flight Center Longwall Program tested the performance of several shearer and conveyor sensors and then examined design problems associated with retrofitting the shearer and conveyor with the most promising sensors.

Finally, Chang and Wait have disclosed a theoretical proposal for using a resonant loop antenna as a probe for the determination of roof thickness in a coal mine operation. See D. Chang and J. Wait, *An Analysis of a Resonant Loop as an Electromagnetic Sensor of Coal Seam Thickness,* Proceedings of URSI Conference on Remote Sensing, LaBaule, France (Apr. 28-May 6, 1977).

SUMMARY OF THE PRESENT INVENTION

It is therefore an object of the present invention to provide an improved method for the remote control of a longwall shearer or continuous mining machine capable of keeping mine personnel out of the hazardous coal cutting zone.

It is another object of the present invention to provide an improved method for the remote control of a longwall shearer or continuous mining machine using a reliable communication system.

It is another object of the present invention to provide a reliable remote communication system that can be easily coupled to a longwall shearer or continuous mining machine.

It is another object of the present invention to provide an improved method for the remote control of a longwall shearer or continuous mining machine which utilizes a coal-rock interface sensor.

Briefly, an embodiment of the present invention includes a medium frequency (MF) remote control system which is magnetically coupled to the AC power cable of the shearer at a remote location. Inside the shearer, an MF receiver is coupled to the AC power cable using a ferrite (c core) line coupler. The shearer is equipped with a coal-rock interface sensor which permits remote control of the mining operation.

An advantage of the present invention is that the remote control operation of the longwall shearer or continuous mining machine keeps mine personnel out of the hazardous coal cutting zone.

Another advantage of the present invention is that the coal-rock interface sensor reduces the likelihood that the shearer cutting edge will strike rock.

Another advantage of the present invention is that a thin layer of coal can be left on the roof of the mine.

Still another advantage of the present invention is that the remote communication system reliably transmits data.

A further advantage of the present invention is that the remote communication system can be easily coupled to the longwall shearer or continuous mining machine.

These and other objects and advantages of the present invention will no doubt become obvious to those of ordinary skill in the art after having read the following detailed description of the preferred embodiment which is illustrated in the various drawing figures.

IN THE DRAWING

DETAILED DESCRIPTION OF THE PREFERRED EMBODIMENT

Figure 1:
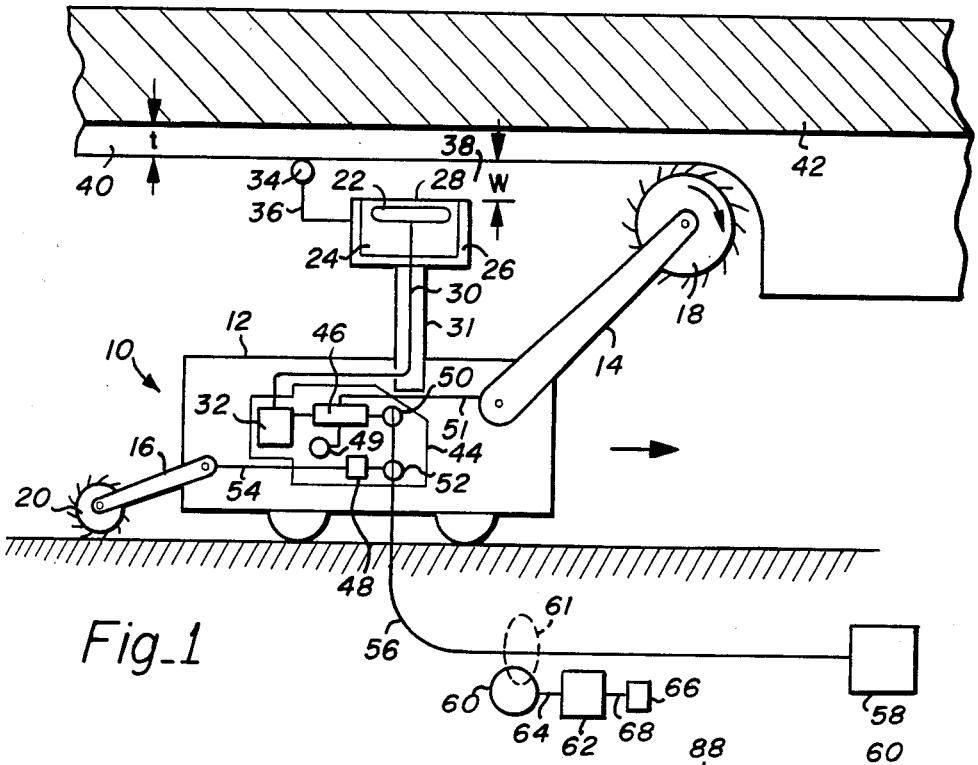
FIG. 1 is a diagram of a remote controlled coal shearer in accordance with the present invention.

Referrring now to FIG. 1, there is shown a remote controlled coal cutting machine designated by the general reference numeral 10 suitable for conducting the remote controlled mining method of the present invention. The coal cutting machine 10 could be either a longwall shearer or a continuous mining machine. A shearer 12 contains a headgate ranging arm 14 and a tailgate ranging arm 16. Headgate ranging arm 14 contains a headgate coal cutting drum 18 and tailgate ranging arm 16 contains a tailgate coal cutting drum 20. A coal-rock interface sensor 22 is mounted on the top of shearer 12 behind headgate ranging arm 14. Sensor 22 is embedded in a disk 24 which is mounted to a steel pipe 26 with a top cover 28 remaining exposed. A cable 30 running through a sensor arm 31 connects sensor 22 to a sensor control unit 32. A wheel 34 attached to steel pipe 26 by an arm 36 creates an air gap 38 having a width "w" by pressing on a coal layer 40. Coal layer 40 has a thickness "t" and lies underneath a rock layer 42. An explosion proof enclosure 44 lies within shearer 12 and contains sensor control unit 32, a headgate remote control unit 46 and a tailgate remote control unit 48. Attached to headgate control unit 46 is an electrohydraulic system control unit 49 and a headgate RF signal coupler 50 which activates an electrohydraulic solenoid valve and hose 51. Attached to tailgate control unit 48 is a tailgate RF signal coupler 52 and a tailgate electrohydraulic solenoid valve and hose 54. An AC power cable 56 is connected to a power center 58. A loop antenna 60 is magnetically coupled to cable 56 by a magnetic field 61. The loop antenna 60 is connected to a transmitter 62 by a wire 64. An interface 66 is connected to transmitter 62 by a wire 68.

Figure 2:
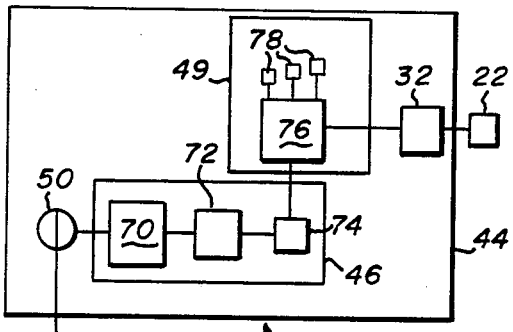
FIG. 2 is a partial, expanded block diagram of the electronic components inside the explosion proof enclosure of FIG. 1.

FIG. 2 shows a partial, expanded block diagram of the electronic components which would be contained within enclosure 44. Headgate remote control unit 46 contains a control board 70 which is connected to a receiver 72 which is connected to a decoder 74. Decoder 74 is connected to a relay control unit 76 which is connected to a plurality of switches 78, all of which are contained within the elctrohydraulic control unit 49. A second set of components similar to those shown in FIG. 2 would be necessary for the tailgate remote control unit 48.

Figure 3:
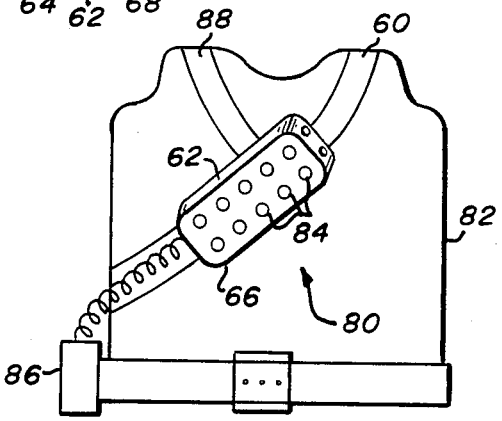
FIG. 3 shows a personal carried remote control transmitter bandolier.

FIG. 3 shows a personal carried (PC) remote control transmitter bandolier designated by the general reference numeral 80. Bandolier 80 is designed to be worn by mine worker 82. As can be seen in FIG. 3, interface 66, transmitter 62 and loop antenna 60 from FIG. 1 are all contained on bandolier 80. Interface 66 contains a plurality of push button control switches 84. A battery 86 powers transmitter 62 and a strap 88 is provided for adjusting bandolier 80.

Figure 4:
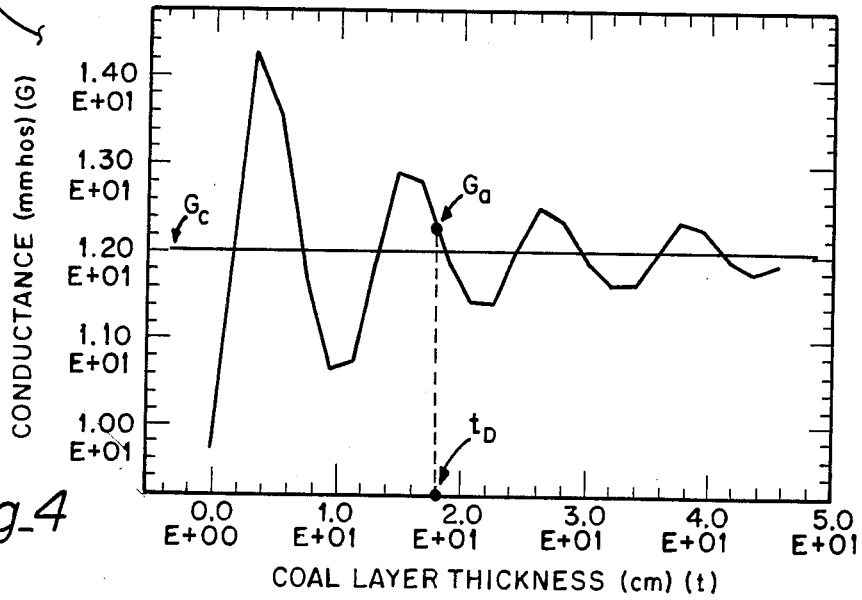
FIG. 4 is a graphical representation of conductance versus coal layer thickness data obtained from the coal-rock interface sensor of FIG. 1.

FIG. 4 shows a representative graph of conductance versus coal layer thickness ("t" in FIG. 1). This is the type of data that is collected with the coal-rock interface sensor 22 shown in FIG. 1. The data in FIG. 4 shows that there is a conductance value $G_c$ about which the conductance G oscillates and to which G converges at infinite thickness. The discrete thicknesses at which G is equal to a value $G_a$ will be the control thicknesses to "$t_D$". As the measured conductance G becomes greater than $G_a$, this will indicate that a correction is necessary in the position of the cutting drum 18. As the measured conductance G becomes less than $G_a$, this will indicate that a correction is necessary in the opposite direction.

In the preferred embodiment of the present invention interface 66 in FIG. 1 is a keyboard mounted on the face of transmitter 62 as shown in FIG. 3. The push button control switches 84 replicate switches 78 on the shearer so that commands sent by the transmitter 62 cause the same response in the shearer's electrohydraulic control unit 49 as switches 78 would. Thus, with the PC transmitter 80 and control units 46 and 48 mounted inside the shearer flame proof enclosure 44, the system allows for the independent remote control of the following shearer functions:

| FUNCTION | HEADGATE DRUM | TAILGATE DRUM |
|---|---|---|
| Water Spray | X | X |
| Cowl CW | X | X |
| Cowl CCW | X | X |
| Ranging Arm Up | X | X |
| Ranging Arm Down | X | X |
| Tram → | X | X |
| Tram ← | X | X |
| Lump Breaker Up | | X |
| Lump Breaker Down | | X |
| Unspecified | X | X |
| Tram Stop | X | X |

-continued

| FUNCTION | HEADGATE DRUM | TAILGATE DRUM |
|---|---|---|
| Emergency Stop | X | X |

Transmitter 62 and receiver 72 operate in the medium frequency (MF) range of three hundred to one thousand kHz. The frequency plan for independent operation of each drum 18 and 20 will require two transmitter carrier frequencies ($f_1$, $f_1$*). These frequencies should be at least fifty kHz apart. The suggested two frequencies are at four hundred and five hundred twenty kHz. The RF line coupler (current transformers) 50 and 52 are used to couple command and control signals from the AC power cable 56. This coupling approach is unique in that it is a ferrite coupler which is of small physical size so it can be designed into the explosion proof enclosure 44. By mounting the coupler inside an explosion proof case, the reliability of the equipment is enhanced. By way of contrast, VHF and UHF equipment requires an exposed antenna which can easily be damaged. The receiver output signal contains control information for the shearer's electrohydraulic system. The digital control signal is applied to the decoder 74 which in turn processes the digital signal by envoking algorithms that minimize the bit error rate. The control signals (called "command signals") will be encoded (in the remote control transmitter 62) with a highly structured digital code word. The code word will include the address and command data. To minimize error, the decoder 74 accepts only digital control signals with the correct address; furthermore, the control signals must be correctly received two or three times with at least two of the received words being identical before the code is validated. A microcomputer in the receiver decoder will detect any error in the digital command data. This insures that only correct commands will be given to the shearer electrohydraulic system. The decoded output signal is then applied to the relay circuit 76 which interface (relay contacts) with the existing shearer control 78 (push buttons and switches).

The digital control signal structure for each word transmitter 62 includes a fifteen bit preamble that is used to synchronize the remote control decoder 74 so the address and command data may be recovered; furthermore, only three address bits (TXID) are required for the shearer and twelve functions are needed in most remote control applications.

The technical reason for sending a sequence of identical words is that the bit error rate of the digital word can be improved. The bit error rate of n replicated words is given by:

$$P_T=(P_A)^n$$

where $P_A$ is the probability of a bit error in a single word. For example, if the bit error rate is $10^{-3}$, the sending of two identical words would improve the bit error rate to $10^{-6}$.

Each word will be encoded using a manchester format. The manchester command data will be applied to a frequency shift key (FSK) encoder in the transmitter 62. An FSK decoder 74 will be used in the remote control unit 46 to recover the command data.

The frequency modulated (FM) carrier will be used in the data transmission system. The carrier frequency will be in the MF band and will feature FSK modulation (1200 Hz and 2200 Hz).

The manchester code phase change indicates the logic bit status. A manchester code down transition (phase) occurs in the middle of the nonreturn to zero (NRZ) data bit. An upward manchester code transition indicates a logic "0". The transition in the manchester code carries the clock synchronization signal (half clock rate).

The first three logic bits identify the address (transmitter ID) and add a measure of security to the code structure. The following twelve control logic bits are utilized for independent (simultaneous) control functions.

The microcomputer read only memory (ROM) contains the manchester decoding algorithm which decodes the manchester code, checks for shearer operator error and enables the proper output lines.

Depressing any transmitter key pad or switch causes the bit state to change to the logic "1" in the control bit sequence. The microcomputer algorithm decodes the bit as logic "1" enabling the corresponding MP output port. No parity will be transmitted with the code; however, error detection will be provided by the follow-up checks:

No data in C16 (end of work overlap-code collision).

No data prior to the start bit.

TXID must be correct as set by rocker arm switches on the MP and transmitter printed circuit boards.

Simultaneous depression of ranging arm, cowl, lump breaker, or tram speed key pads will be ignored. Depressing the tram speed keys will cause the tram servo speed control to be programmed to zero.

Each control word transmission period is:

$$32 \text{ bits} \times \frac{1 \text{ sec}}{300 \text{ bit}} = 107 \ m/s.$$

Depressing a key pad or switch will cause immediate multiple words to be transmitted, two of which must be decoded as identical. Further, the transmitter will send a supervion signal every ten seconds. Failure of detection or supervion shall enable the tram stop command function. The up algorithm can be modified to achieve many additional control strategies.

The use of the coal-rock interface sensor 22 shown in FIG. 1 is important to the present invention because with current shearer equipment, an operator cannot tell where the coal-rock interface is until it is encountered. The operator can attempt to be conservative by trying to leave a substantial coal layer on the roof, or he can attempt to stop cutting as soon as possible once he has encountered rock. In the first instance, the operator may leave more coal on the roof than necessary, reducing total production by perhaps as much as five to six percent. In the second instance, if not enough coal is left on the roof, roof control problems increase. In marginal seams, the coal nearest the roof may contain a higher percentage of sulfur and ash, so if cut, the quality of the coal mined is reduced.

If the operator cuts into the rock, additional problems arise. When the cutting edges of drum 18 strike rock, flying sparks can cause methane and coal dust ignitions. Silica in the dust makes it difficult comply with MSHA respirable dust regulations. Furthermore, the coal is contaminated thereby decreasing overall coal quality. Besides the above problems, cutting into rock increases wear and tear on the cutting drum 18 and mechanical components of the shearer 12 and leads to additional maintenance and down time. Any possible option taken to reduce these problems increases cost.

With the use of a reliable coal-rock interface sensor 22, a thin layer of coal "t" can be left on the roof so roof control problems, safety and cost are reduced while production and coal quality are increased. For example, under shale and mudstone roof rock 42, the thin layer of coal prevents the rock 42 from spalling due to exposure to air. This helps ensure a competent roof in the face area.

Safety can further be enhanced if the sensor 22 is used in conjunction with a remote control link. Currently the operator must be in close proximity to the coal cutting edges of drum 18 so he can see the cutting horizon and keep the cutting edges from striking rock. With a remote control link, information on the coal layer thickness "t" will be supplied to the operator at a remote location. This will allow the operator to control the shearer 12 way from the hazardous cutting zone. Furthermore, with the operator controlling the shearer 12 out of the dust plume and away from the hazardous face, productivity increases since cutting can be done in both directions from the face ventilation air flow.

The electronic design of the coal-rock interface sensor 22 used in the present invention is based on the measurement of the input admittance of a tuned loop antenna. The theoretical work which is most applicable to sensor 22 was done by Chang and Wait, supra.

With proper shielding, the electrical properties of a resonant loop are influenced only by the roof structure. No significant disturbance results from the scattering due to nearby mining equipment.

The sensor antenna is mounted within the vertical steel pipe 26 which is located approximately in the center of tram 12 and immediately below the coal slab 40. The electronic assembly 32 containing the required circuits is mounted inside the explosion proof enclosure 44 on the tram 12. The enclosure 44 will provide a dust free environment for the printed circuit board package.

The resonant loop antenna input admittance is measured in real time. The admittance is mathematically represented by:

$$Y=G+jB$$

where

G=input conductance of the loop antenna in mhos, and

B=input susceptance.

There are several means of measuring the antenna input admittance. The two methods which are commonly used in commercial instrument designs are:

Directional Coupler and

Directional Bridge.

Since multiple frequencies of operation are not required with the resonant loop antenna, the directional coupler design will be used. The determination of admittance is based on the measurement of load plane reflection coefficients mathematically represented by:

$$\Gamma = \frac{Z_L - Z_O}{Z_L + Z_O} = |\Gamma|\, e^{j\theta}$$

where $Z_L$=load plane impedance, and $Z_O$=characteristic impedance of the transmission line connecting the measurement unit to the load plane.

The oscillator network generates an RF test signal which is applied to the directional coupler which is terminated in the antenna load plane admittance. The vector ratio components of the reflected wave to the incident wave are detected. The reflection coefficient is defined as:

$$\Gamma = \frac{V_{ref}}{V_{inc}} = |\Gamma|(\cos\theta + j\sin\theta) = |\Gamma| < \theta$$

where $V_{ref}$=*voltage level of the reflected wave, and*

$V_{inc}$=voltage level of incident wave.

The reflection coefficient and impedance values follow from:

$$Z_L = Z_O \frac{1+\Gamma}{1-\Gamma}$$

Input admittance is the inverse of $Z_L$:

$$Y=1/Z_L=G+jB$$

For a voltage signal of unit amplitude, the value of G corresponds exactly to the radiated power from the antenna. A microcomputer will use the phase and amplitude measurement data to determine the reflection coefficient and value of G.

In order to use the coal-rock interface sensor 22, the sensor must be calibrated by taking measurements at various increments of coal thickness "t". To accomplish this calibration, the shearer will cut vertically through coal layer 40 to the rock 42, back off an incremental distance from rock 42, advance longitudinally into coal layer 40 for a short distance and back off another incremental vertical distance from rock 42. This procedure will be repeated with measurements being made and stored for each thickness "t". This calibration provides a discrete set of allowable thicknesses "t" for which control will be possible.

Next, the operator selects the desired thickness "$t_D$" of coal to leave on the roof/floor from the set of allowed values. The shearer must then be placed at a position corresponding to this thickness; this is accomplished by cutting into rock 42 and backing off by the specified distance.

The shearing operation then begins. As the shearer 12 proceeds, the sensor 22 will monitor its position with respect to rock 42 by comparing current measurements with the stored calibration data. If the measurement is greater than the stored value for the specified thickness "$t_D$", a light will turn on indicating correction is necessary in a certain direction (up or down). If the measurement is less than the stored value, a light will turn on indicating correction is necessary in the opposite direction. The required corrections can be made either at the shearer location or at a remote location using transmitter 62.

In the preferred embodiment of the present invention, the coal-rock interface sensor 22 is a tuned loop antenna with no moving parts. The loop and cable connection 30 which carries the UHF signal to the antenna will be embedded in a solid, abrasion resistant, high strength plastic disk 24. The disk will be mounted in a heavy steel tube with only the top surface of the disk 28 exposed.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A method for controlling the thickness of a layer of coal left in a coal seam bordered by a layer of rock which comprises:

a. calculating a control electrical conductance value;

b. placing a sensor for measuring electrical conductance at a position near the coal seam such that said control electrical conductance value is registered by said sensor;

c. moving said sensor transversely along said coal seam with a coal cutting drum which is positioned to cut into said coal seam at a discrete cutting depth; and d. readjusting said cutting depth of said coal cutting drum when said sensor detects a specified change in electrical conductance from said control electrical conductance value.

2. The method of claim 1 wherein the step of calculating said control electrical conductance value comprises:

a. utilizing said coal cutting drum to cut through the coal seam until the layer of rock is encountered;

b. adjusting said cutting depth of said coal cutting drum an incremental amount so that a first coal layer will be left between said layer of rock and said coal cutting drum after advancing said coal cutting drum into said coal seam;

c. advancing said coal cutting drum longitudinally into said coal seam an incremental distance;

d. stopping said advance;

e. using said sensor to measure a first electrical conductance value in said first coal layer;

f. storing said first electrical conductance value in a microcomputer;

g. repeating steps (b) through (f) so that a plurality of electrical conductance values are obtained for a plurality of coal layers each successive coal layer having a greater thickness than the preceding coal layer; and h. using said microcomputer to calculate said control electrical conductance value from at least some of said plurality of electrical conductance values.

3. The method of claim 1 wherein, the step of readjusting said cutting depth of said coal cutting drum when said sensor detects a specified change in conductance from said control electrical conductance value is performed at a remote location by using a medium frequency remote control transmitter.

4. A method for remotely controlling the mechanical functions of a coal cutting machine's electrohydraulic system comprising:

a. inductively coupling a medium frequency mobile transmitter to an AC power cable running to said coal cutting machine;

b. coupling said AC power cable to a remote control unit of said coal cutting machine using a ferrite line coupler;

c. enclosing the remote control unit and the ferrite line coupler inside of an explosion proof enclosure;

d. encoding a command signal into a digital code format;

e. applying the digitally encoded command signal to a frequency shift key encoder;

f. frequency modulating a carrier frequency;

g. transmitting the encoded command signal over the frequency modulated carrier frequency from said medium frequency mobile transmitter to said remote control unit; and h. transmitting the command signal from said remote control unit to an electrohydraulic system control unit.

5. The method of claim 4 wherein, said coal cutting machine is a longwall shearer.

6. The method of claim 4 wherein, said coal cutting machine is a continuous mining machine.

7. A method for controlling the thickness of a layer of coal left in a coal seam bordered by a layer of rock which comprises:

a. calculating a control electrical conductance value by:

i. utilizing a coal cutting drum to cut through a coal seam until a layer of rock is encountered, ii. repositioning the coal cutting drum at a new cutting depth so that a first coal layer will be left between the layer of rock and the coal cutting drum after the coal cutting drum is advanced longitudinally into the coal seam, iii. advancing the coal cutting drum longitudinally into the coal seam an incremental distance, iv. stopping the advance, v. using a sensor designed to measure electrical conductance to measure a first electrical conductance value in the first coal layer, vi. storing the first electrical conductance value in a microcomputer, vii. repeating steps (ii) through (vi) so that a plurality of electrical conductance values are obtained for a plurality of coal layers having a plurality of thicknesses, viii. calculating the control electrical conductance value from at least some of the plurality of electrical conductance values;

b. positioning the coal cutting drum at a cutting depth in the coal seam such that the control electrical conductance value will be registered by the sensor;

c. moving the sensor longitudinally along the coal seam with the coal cutting drum while the coal cutting drum is cutting coal; and d. readjusting the cutting depth of the coal cutting drum when the sensor detects a specified change in electrical conductance from the control electrical conductance value.

8. The method of claim 7 wherein, the step of readjusting said cutting depth of said coal cutting drum when said sensor detects a specified change in conductance from said control electrical conductance value is performed at a remote location by using a medium frequency control transmitter.

* * * * *